US007412741B2

(12) United States Patent
Roney et al.

(10) Patent No.: US 7,412,741 B2
(45) Date of Patent: Aug. 19, 2008

(54) APPARATUS AND METHODS FOR CLEANING COOLING SLOT SURFACES ON A ROTOR WHEEL OF A GAS TURBINE

(75) Inventors: Robert M. Roney, Schoharie, NY (US); John R. McCarvill, Clifton Park, NY (US); Paul C. Bagley, Middleburgh, NY (US); Richard Hatley, Convent Station, NJ (US)

(73) Assignee: General Electric Company, Schenectady, NY (US)

( * ) Notice: Subject to any disclaimer, the term of this patent is extended or adjusted under 35 U.S.C. 154(b) by 701 days.

(21) Appl. No.: 10/965,736

(22) Filed: Oct. 18, 2004

(65) Prior Publication Data

US 2006/0083612 A1 Apr. 20, 2006

(51) Int. Cl.
*B08B 7/00* (2006.01)
*B24D 15/00* (2006.01)

(52) U.S. Cl. ..... 15/104.001; 15/246; 134/6; 451/525

(58) Field of Classification Search ..... 15/104.05, 15/246, 236.01, 104.001, 93.1; 416/61; 134/6; 29/889.7, 889.721, 889.722; 451/520, 523–525, 451/495

See application file for complete search history.

(56) References Cited

U.S. PATENT DOCUMENTS

| | | | | |
|---|---|---|---|---|
| 2,815,616 | A * | 12/1957 | Barrett | 451/521 |
| 4,845,901 | A * | 7/1989 | Hamlin | 451/523 |
| 6,171,177 | B1 * | 1/2001 | Fitz | 451/59 |
| 2006/0156544 | A1 * | 7/2006 | Sherlock et al. | 29/889.7 |

FOREIGN PATENT DOCUMENTS

| | | | |
|---|---|---|---|
| JP | 61029260 | A | 5/1994 |
| JP | 20033402 | A | 1/2003 |

OTHER PUBLICATIONS

English Abstract of JP61029260 A, published May 20, 2004.
English Abstract of JP20033402 A, published Jan. 8, 2003.
European Search Report, Jan. 17, 2006.

* cited by examiner

*Primary Examiner*—Laura C Guidotti
(74) *Attorney, Agent, or Firm*—Nixon & Vanderhye, PC

(57) ABSTRACT

The cleaning system includes a plurality of generally dovetail-shaped slot blocks having a slot along a radial inner side, an abrasive media or belt and a backing tube. Upon insertion of the blocks into the dovetail slots of a rotor wheel and aligning the block slots with the cooling slot, the abrasive media and backing tube are inserted in the cooling slot tunnel. The abrasive media may extend through end feeder blocks. With the backing tube applying pressure radially outwardly against the abrasive media, back and forth motion applied manually from outboard of the rim of the rotor cleans the surfaces of the cooling slot without disassembly of the rotor.

14 Claims, 4 Drawing Sheets

APPARATUS AND METHODS FOR CLEANING COOLING SLOT SURFACES ON A ROTOR WHEEL OF A GAS TURBINE

BACKGROUND OF THE INVENTION

The present invention relates to a cleaning system for removing foreign material from a cooling slot surface of a gas turbine rotor wheel, and particularly to a cleaning system which is applied from the exterior of the rotor wheel for cleaning the cooling surfaces along the cooling slot along the underside of the dovetails.

Rotor wheels, e.g., for gas turbines, typically include a plurality of circumferentially spaced dovetails about the outer periphery of the rotor wheel defining dovetail slots therebetween. The dovetail slots receive corresponding dovetail shaped bases of buckets which carry the plurality of airfoils about the rotor wheel. The buckets or airfoils are often cooled by air entering through a cooling slot in the rotor wheel and through grooves or slots formed in the bases of the buckets. Typically, the cooling slot extends circumferentially 360° through the dovetails and the dovetail slots.

Gas turbine cooling slots are typically inspected via an eddy current testing methods. For acceptable eddy current test results, the areas of inspection must be clean and free of foreign materials, such as dust, rust, scale deposits, oil, grit and the like. There is therefore a need to clean one or more surfaces of the cooling slot without disassembly of the rotor and consequent turbine downtime.

BRIEF DESCRIPTION OF THE INVENTION

In an example of the invention, there is provided a system for cleaning surfaces of a cooling slot about a gas turbine rotor wheel having a plurality of circumferentially spaced dovetails defining dovetail slots therebetween. The cooling slot extends circumferentially through the dovetails and the dovetail slots. A plurality of blocks are provided and have a shape generally corresponding to and for insertion into at least base portions of the dovetail slots. Each of the blocks has a slot for alignment with the circumferentially extending cooling slots through the adjacent dovetails. An elongated element has at least one abrasive surface for insertion into the circumferentially aligned slots through the blocks and through the dovetails to clean the cooling slot surfaces.

In a further example of the invention, there is provided a method of cleaning surfaces of a cooling air slot about a gas turbine rotor wheel having a plurality of circumferentially spaced dovetails defining dovetail slots therebetween, the cooling air slot extending circumferentially through the dovetails and dovetail slots. The method includes the steps of inserting guides having guide surfaces into adjacent dovetail slots with the guide surfaces generally aligned with the circumferentially extending cooling slot; passing an element having at least one abrasive surface through the circumferentially extending cooling air slot and past the guide surfaces; and displacing the element along the circumferentially extending cooling slot and guide surfaces to abrasively clean the cooling air slot surfaces.

DETAILED DESCRIPTION OF THE INVENTION

Figure 1:
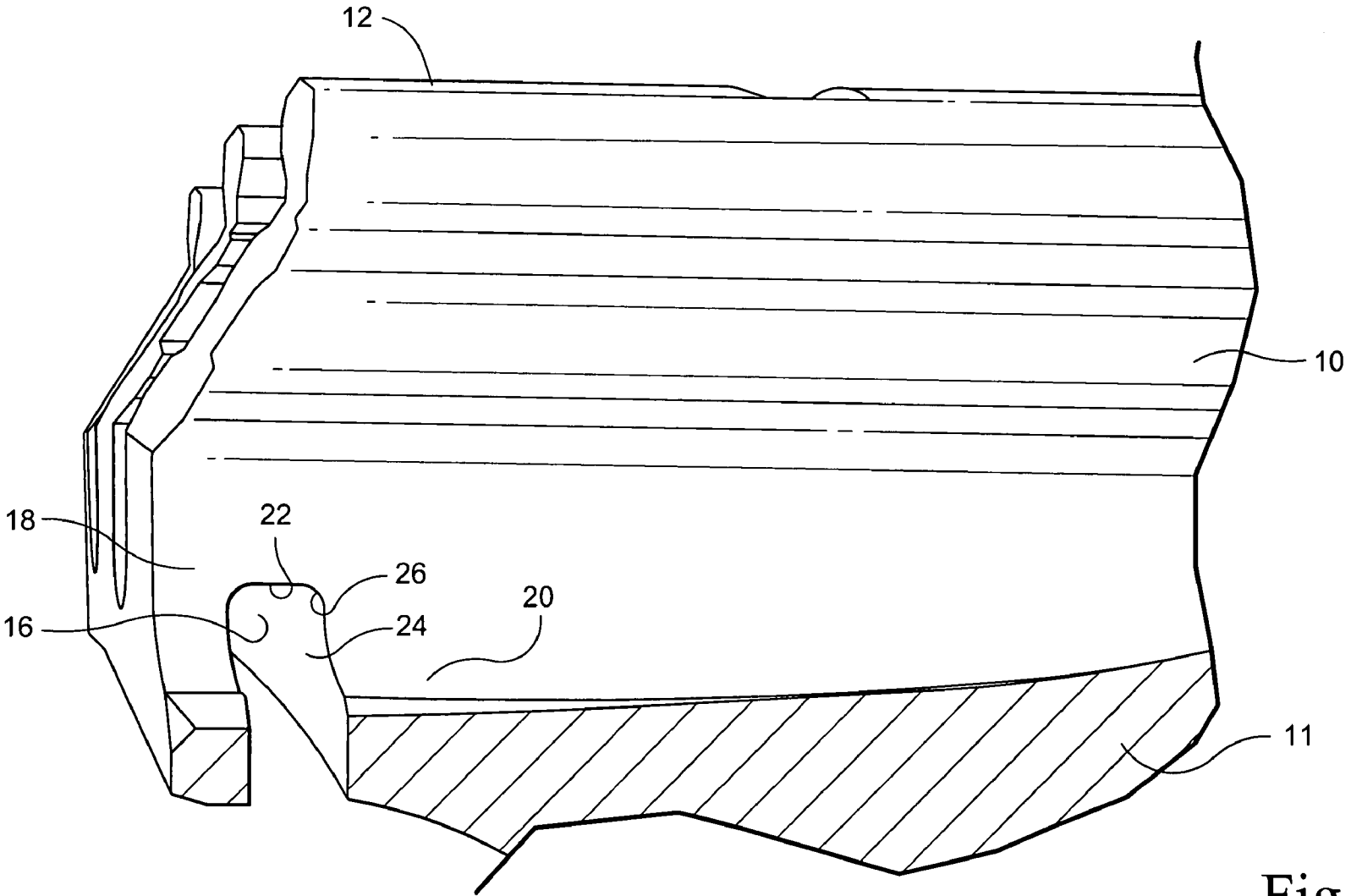
FIG. 1 is a fragmentary perspective view of a portion of the rim of a gas turbine rotor wheel illustrating the dovetails and dovetail slots.
Figure 2:
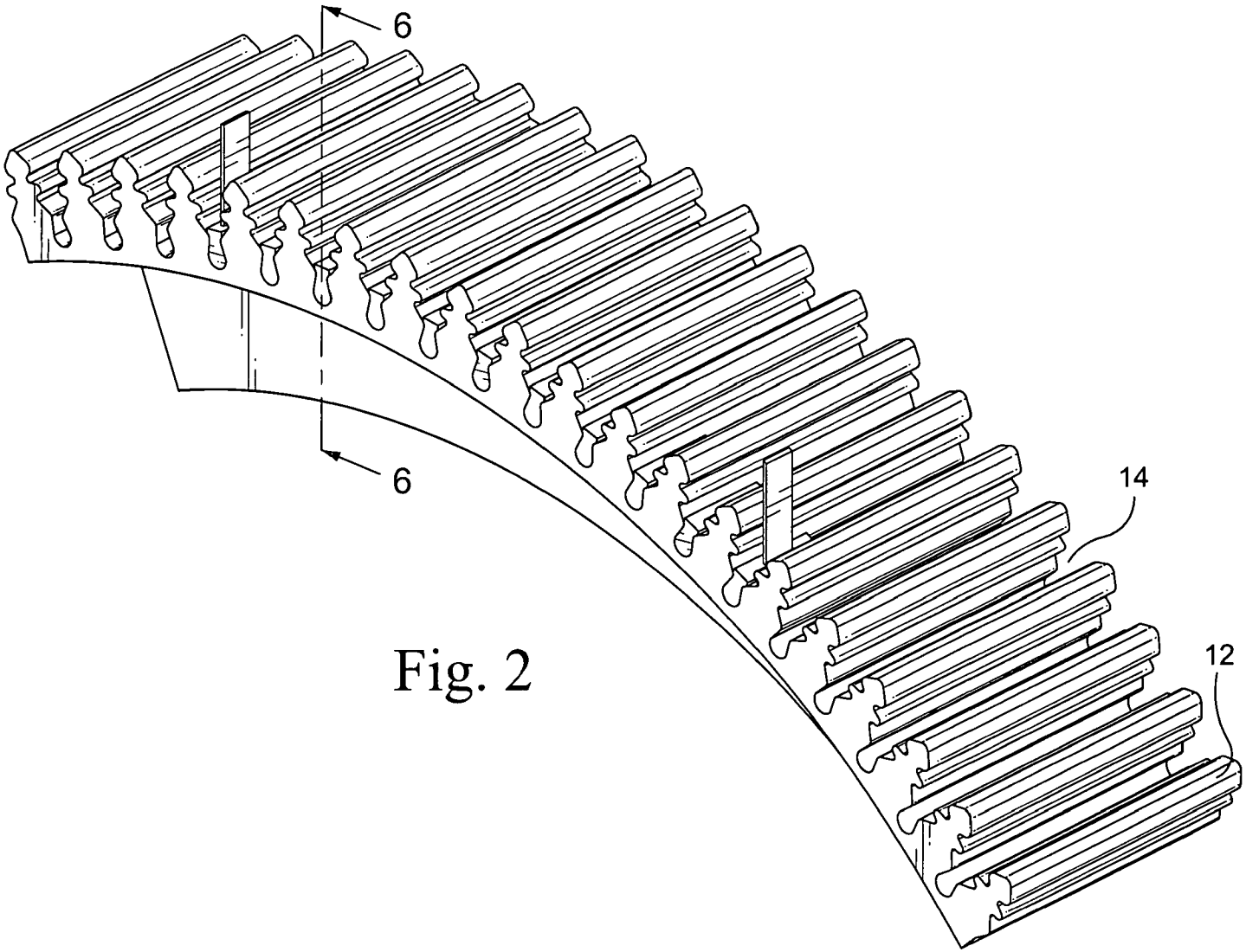
FIG. 2 is a fragmentary perspective view of the rim of a rotor wheel illustrating the dovetails, dovetail slots and a cleaning system for the cooling slot inserted within the dovetails.

Referring now to the drawings, particularly to FIG. 1, there is illustrated a portion of a rim 10 of a rotor wheel 11 for a gas turbine. As best illustrated in FIGS. 1 and 2, the rim 10 includes a plurality of dovetails 12 circumferentially spaced one from the other and defining dovetail slots 14 between adjacent dovetails 12. The dovetails 12 each have a groove/rib configuration along opposite side walls. The dovetail slots 14 receive generally correspondingly shaped dovetails of buckets, not shown. The buckets thus form a circumferential array of airfoils about the rotor wheel 11. The dovetail slots 14 as illustrated are typically termed "axial entry" slots whereby the bases of the buckets are received in the slots 14 in a generally axial direction.

Referring to FIG. 1, the forward or upstream axial face of the rotor wheel is provided with a cooling slot 16 along undersides of the dovetails 12. The cooling slot 16 extends circumferentially a full 360° and passes through the base 18 of each dovetail 12 and through the base of each dovetail slot 14. It will be appreciated that when the buckets are installed on the rotor wheel, cooling air, e.g., compressor discharge air, is supplied to the cooling slot 16 which in turn supplies cooling air into the base portion 20 of the dovetail slot for transmittal through grooves or slots opening through the base of the bucket for cooling the interior of the bucket airfoil. As noted previously, it is important, particularly from the necessity to inspect the cooling slots 16 via an eddy current testing method to, prior to testing, clean the slots so that the slot surfaces are free of dust, rust, scale deposits, oil, grit and the like which otherwise deleteriously affect the eddy current testing. Referring to FIG. 1, the slot surfaces which are to be cleaned in accordance with a preferred embodiment of the invention are the inwardly facing radial outermost surfaces 22 of the cooling slot 16, the axial forward or upstream facing surface 24 of each dovetail forming the cooling slot 16 and the radius 26 between the surfaces 22 and 24.

In accordance with a preferred embodiment of the present invention, the cleaning system hereof includes a plurality of slot blocks 30, an abrasive belt 32, and a backing member, e.g. a tube 34. Each of the slot blocks 30 has opposite sides generally corresponding to the shape of the base of the dovetail slots 14 together with a rib/groove arrangement, preferably only a single laterally projecting rib 36 being formed along its opposite sides. The slot block 30 has only a limited axial extent, i.e. length, sufficient for insertion generally axially into the dovetail slots 14 from the forward axial face of the rotor wheel to overlie the cooling slot 16, although it will be appreciated that the slot blocks 30 may extend short of, correspond in length to or extend in excess of the length of the dovetail slots 14. The slot block 30 also includes a transverse slot 38 along a base portion thereof intermediate its opposite ends. The radial extent of the slot 38 is such that upon insertion of the slot block 30 into a dovetail slot 14, the base 40 of the slot 38 forms a continuation of the cooling slot surface 22.

Figure 6:
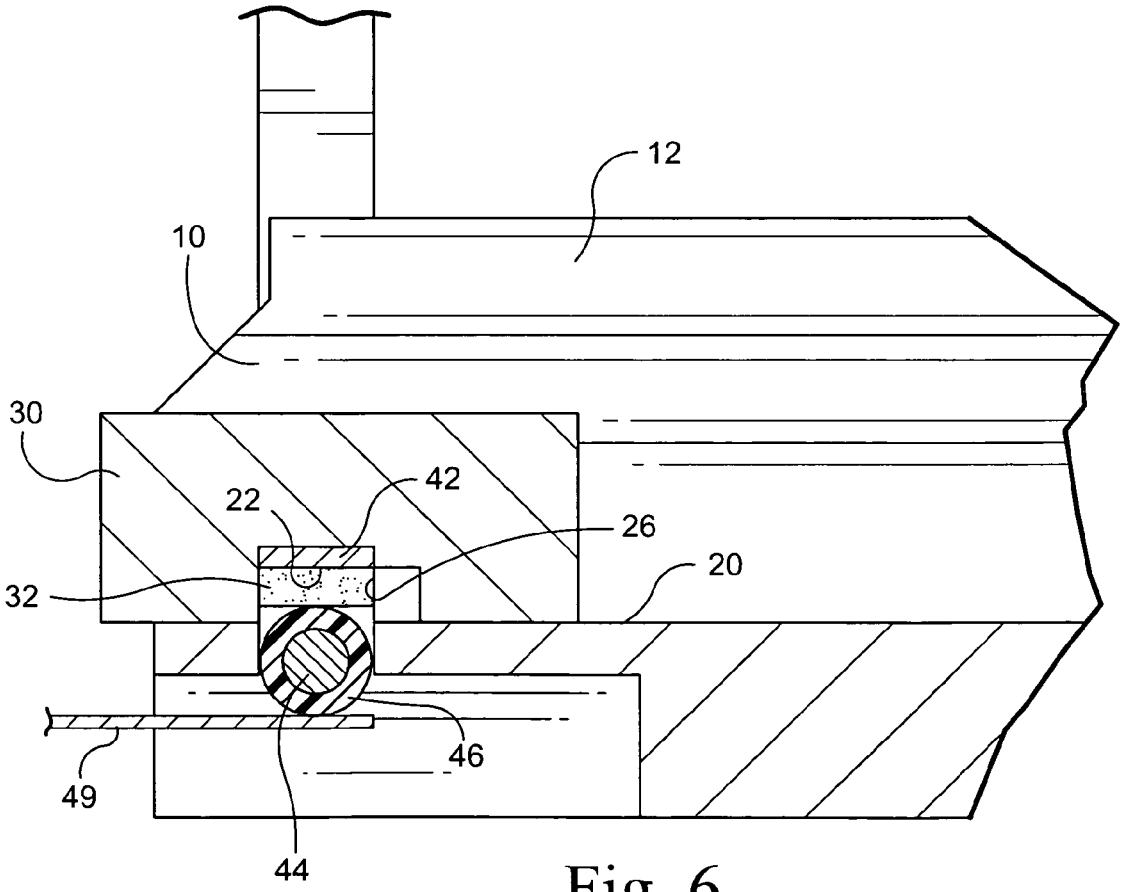
FIG. 6 is an enlarged fragmentary cross sectional view through the dovetail slot illustrating the cleaning system in place for cleaning a surface of the cooling slot.

The abrasive belt 32 is preferably formed of an abrasive media such as 3M Scotchbright™ cut to a specific width of the cooling slot 16. Other types of abrasive media may be utilized. The backing tube 34 is provided to apply pressure to the abrasive media when the backing tube and abrasive media are disposed in the cooling slot 16. To apply pressure on the backside of the belt to clean the surfaces of the cooling slot, the backing tube 34 preferably comprises a tubular bladder. Particularly, the tubular bladder on tube 44 illustrated in FIG. 6 preferably comprises a latex or silicone tube 44 sealed at one end and encased within a Teflon™ or polyethylene sleeving 46. The sleeving will limit the tube's expansion and will provide an abrasion-resistant low friction casing for the abrasive belt to slide against when the abrasive media is cleaning the cooling slot 16.

Figure 3:
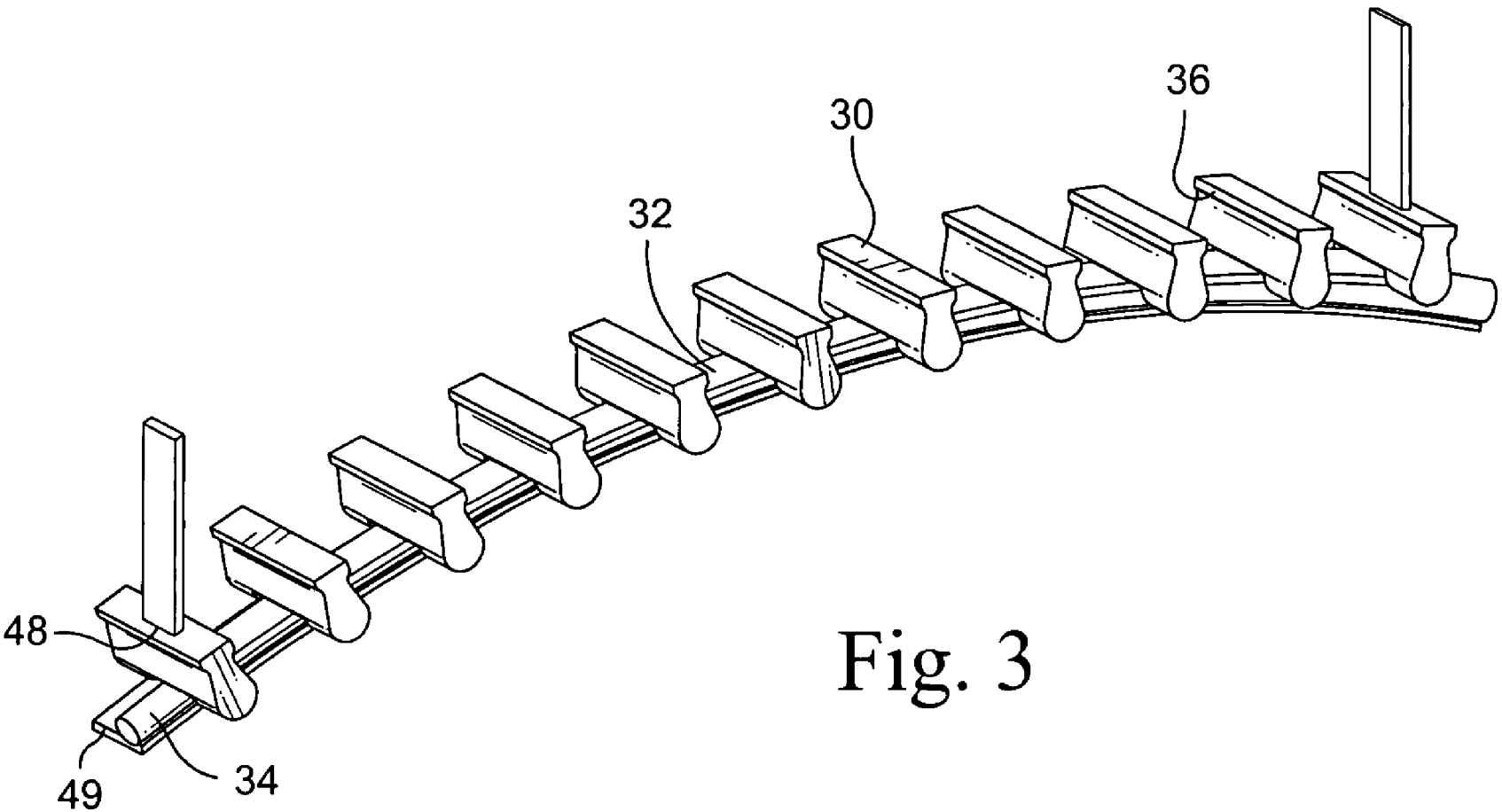
FIG. 3 is a perspective view illustrating the cleaning system hereof as appearing in the dovetail slots but without showing the dovetail slots.

In FIG. 3, the end blocks of a plurality of blocks 30 have feeder slots or grooves 48 which extend radially through the feeder blocks into the block slots 38. The slots 48 in the feeder blocks accommodate only the abrasive media and not the backing tube 34. Additionally, a backing strip 49, for example, formed of spring steel is used to provide a backing for the tubular bladder as described below.

To use the cleaning system hereof, the backing strip 49 is inserted in the gap between the wheel spacer and the cooling slot 16 of the wheel. The slot blocks 30 are then installed, preferably through the forward facing ends of the dovetail slots 14 and form a series or set of blocks 30 which alternate in circumferentially adjacent dovetail slots 14. The blocks are inserted such that their slots 38 align circumferentially with the cooling slot 16. It will be appreciated that by aligning the block slots 38 with the cooling slot 16, a continuous tunnel or arcuate opening about the rim of the rotor wheel is formed. The abrasive media and tube 32 and 34, respectively, are then inserted into the tunnel. The abrasive media 32 also extends through the slots 48 in the feeder blocks at opposite ends of the set of blocks such that the opposite ends project outwardly of the rim of the rotor wheel. The tube 34 extends in the tunnel and through the cooling slot and block slots 38 underlying, e.g., radially inwardly of, the abrasive media 32.

To clean the surfaces 22, 24 and 26, the ends of the abrasive media 32 are moved manually back and forth by grasping the free ends of the media and alternately pulling its opposite ends. With the backing tube bearing against the underside of the media, the abrasive media bears against the surfaces 22, 24 and the radius 26 removing the foreign material as the media moves back and forth in the slot 16. It will be appreciated that the backing tube may be inflatable to provide pressure against the abrasive media, in turn applying pressure against the surfaces to be cleaned. The backing strip 49 provides the reaction surface against which the backing tube pushes against when inflated.

Figure 4:
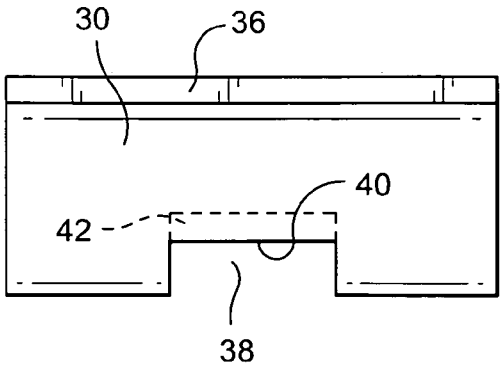
FIG. 4 is a side elevational view of a slot block used in the cleaning system hereof.
Figure 5:
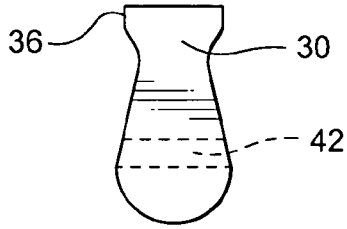
FIG. 5 is an end elevational view of the slot block.

It will be appreciated that by providing end feeder blocks with feeder slots or openings along one side thereof, the edges of the two circumferentially outboard dovetails 12 adjacent the feeder blocks will not contact the edges of those outboard dovetails and will not thereby cause a wearing of those edges. It will also be appreciated that a consumable insert 42 (FIG. 4) may be placed in each slot block to form the base of the slot so that the slot blocks may be reused upon replacing the used or consumed inserts with fresh inserts. Thus, the base 40 engageable by the abrasive media may comprise the metal of the block 30 or the material of insert 40. By applying the slot blocks, abrasive media and backing tube along arcuate sections of the rim of the rotor wheel, the surfaces 22, 24 and 26 of the cooling slot 16 may be cleaned without disassembly of the rotor wheel from the rotor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for cleaning surfaces of a cooling slot about a gas turbine rotor wheel having a plurality of circumferentially spaced dovetails defining dovetail slots therebetween, the cooling slot extending circumferentially through the dovetails and the dovetail slots, comprising:

a plurality of blocks having a shape generally corresponding to and for insertion into at least base portions of said dovetail slots;

each said block having a block slot alignable with the circumferentially extending cooling slot through adjacent dovetails; and an elongated element having at least one abrasive surface for insertion into the circumferentially extending cooling slot through said block slots and through the dovetails thereby defining a plurality of circumferentially aligned block slots to clean the cooling slot surfaces.

2. A system according to claim 1 including an elongated member for insertion into the circumferentially aligned block slots and the slots through adjacent dovetails for applying pressure to said element to bear said one abrasive surface thereof against cooling slot surfaces.

3. A system according to claim 2 wherein the member comprises a tubular bladder formed of a latex or silicone material.

4. A system according to claim 3 wherein said tubular bladder is encased within a sleeve.

5. A system according to claim 4 wherein said sleeve is formed of a polyethylene or polytetrafluoroethylene material to afford an abrasion-resistant low friction casing for the tubular bladder.

6. A system according to claim 1 including a pair of feeder blocks, each having an opening along one side of or through the feeder block for receiving an end of the element and spacing the element away from edges of adjacent dovetails adjacent the feeder blocks.

7. A system according to claim 1 including a wear insert exposed in the slot of the blocks to reduce wear on the blocks.

8. A method of cleaning surfaces of a cooling air slot about a gas turbine rotor wheel having a plurality of circumferentially spaced dovetails defining dovetail slots therebetween, the cooling air slot extending circumferentially through the dovetails and dovetail slots comprising the steps of:

inserting guides having guide surfaces into adjacent dovetail slots with the guide surfaces generally aligned with the circumferentially extending cooling air slot;

passing an element having at least one abrasive surface through the circumferentially extending cooling air slot and past the guide surfaces; and displacing the element along the circumferentially extending cooling air slot and guide surfaces to abrasively clean the cooling air slot surfaces.

9. A method according to claim 8 including biasing the element against the cooling air slot surfaces.

10. A method according to claim 9 including passing a member through the circumferentially extending cooling air slot and past the guide surfaces to bias the element with the abrasive surface against the cooling air slot surfaces.

11. A method according to claim 9 including retaining the guides within the dovetail slots by engaging the guides and portions of the dovetails.

12. A method according to claim 9 including providing end feeder guides in the dovetail slots, the end feeder guides having an opening along one side of or through the feeder guides for receiving ends of the element and spacing the element away from edges of adjacent dovetails adjacent the end feeder guides.

13. A method according to claim 8 including extending ends of the element generally radially outwardly of the periphery of the rotor wheel.

14. A method according to claim 8 including reciprocating the element within the cooling air slot past the guide surfaces to clean the cooling air slot surfaces.

* * * * *